US009132981B2

(12) United States Patent
Lee et al.

(10) Patent No.: US 9,132,981 B2
(45) Date of Patent: Sep. 15, 2015

(54) PRINT MEDIUM FINISHING APPARATUS

(71) Applicant: SAMSUNG ELECTRONICS CO., LTD., Suwon-si, Gyeonggi-do (KR)

(72) Inventors: Jae Wuk Lee, Suwon-si (KR); Sang Cheol Kim, Hwaseong-si (KR); Myung Hun Oh, Hwaseong-si (KR); Je Won Jeong, Seoul (KR)

(73) Assignee: SAMSUNG ELECTRONICS CO., LTD., Suwon-Si (KR)

( * ) Notice: Subject to any disclaimer, the term of this patent is extended or adjusted under 35 U.S.C. 154(b) by 0 days.

(21) Appl. No.: 14/273,706

(22) Filed: May 9, 2014

(65) Prior Publication Data

US 2014/0333021 A1 Nov. 13, 2014

(30) Foreign Application Priority Data

May 9, 2013 (KR) ..... 10-2013-0052605

(51) Int. Cl.

*B65H 31/30* (2006.01)
*B65H 31/02* (2006.01)
*B65H 31/26* (2006.01)

(52) U.S. Cl.

CPC ..... *B65H 31/02* (2013.01); *B65H 31/26* (2013.01); *B65H 31/3054* (2013.01); *B65H 31/3081* (2013.01); *B65H 2301/4212* (2013.01); *B65H 2301/4213* (2013.01); *B65H 2404/73* (2013.01); *B65H 2801/27* (2013.01)

(58) Field of Classification Search

CPC .... B65H 31/24; B65H 31/30; B65H 31/3036; B65H 31/3045; B65H 31/3054; B65H 31/3063; B65H 31/3081; B65H 31/32; B65H 2404/73

USPC ..... 271/3.01, 3.03; 270/58.07, 58.08, 270/58.11, 58.12

See application file for complete search history.

(56) References Cited

U.S. PATENT DOCUMENTS

| | | | | |
|---|---|---|---|---|
| 5,545,000 | A * | 8/1996 | Gorsky | 414/790.3 |
| 7,487,959 | B2 * | 2/2009 | Noh | 270/58.12 |
| 8,561,977 | B2 * | 10/2013 | Chang | 270/58.07 |
| 2008/0150213 | A1 * | 6/2008 | Kodama et al. | 270/58.12 |
| 2010/0289205 | A1 * | 11/2010 | Taki | 270/58.08 |
| 2012/0032388 | A1 * | 2/2012 | Jung | 270/58.08 |

* cited by examiner

*Primary Examiner* — Ernesto Suarez
(74) *Attorney, Agent, or Firm* — Staas & Halsey LLP

(57) ABSTRACT

A print medium finishing apparatus is provided. The apparatus includes a conveyance module configured to convey print media on a first tray to a second tray. Since a rotary member of the conveyance module is rotated to support the print media on the first tray during a process in which the conveyance module passes through a through-hole formed in a support section of a main body to move over the first tray, disorder of the print media is reduced during a process of conveying the print media to the second tray.

10 Claims, 7 Drawing Sheets

PRINT MEDIUM FINISHING APPARATUS

CROSS-REFERENCE TO RELATED APPLICATIONS

This application is related to, and claims the priority benefit of, Korean Patent Application No. 10-2013-0052605, filed on May 9, 2013, in the Korean Intellectual Property Office, the disclosure of which is incorporated herein by reference.

BACKGROUND

1. Field

Embodiments of the present invention relate to a print medium finishing apparatus for receiving print media printed by an image forming apparatus or the like and finishing the print media.

2. Description of the Related Art

A print medium finishing apparatus is an apparatus connected to an image forming apparatus such as a printer, a multi-functional apparatus, or the like, and configured to receive print media on which images are formed by the image forming apparatus and perform various types of finishing on the print media.

The print medium finishing apparatus can perform functions such as an alignment operation of aligning print media, a punching operation of punching a binding hole in the print media, a stapling operation of binding a plurality of print media together using a stapler, a binding operation of folding centers of the plurality of print media to obtain a book shape from the print media, and so on.

SUMMARY

Additional aspects and/or advantages will be set forth in part in the description which follows and, in part, will be apparent from the description, or may be learned by practice of the invention.

It is an aspect of an embodiment to provide a print medium finishing apparatus capable of conveying print media stacked on a first tray to a second tray while maintaining the stacked state.

In accordance with an aspect of an embodiment, a print medium finishing apparatus includes a main body, a first tray and a second tray sequentially provided at the main body in a first direction, which is a moving direction of print media, and at least one conveyance module disposed at the first tray and configured to convey the print media on the first tray to the second tray, wherein the main body comprises a support section provided at one side of the first tray and configured to support one ends of the print media stacked on the first tray, and a through-hole formed in the support section and through which the conveyance module moves in the first direction to pass through the support section, the conveyance module comprises a movable member movably installed in the first direction, and a rotary member rotatably installed at the movable member and configured to support the print media on the first tray, and the rotary member is rotated while passing through the through-hole, and supported by the print media.

The apparatus may include a hooking member provided at the rotary member and having a lower end disposed under a rotational center of the rotary member; and a hooking threshold member protruding into the through-hole and to which the lower end of the hooking member is hooked.

The movable member may include a first hinge section at which the rotary member is rotatably installed, the rotary member may include a second hinge section at which the first hinge section is rotatably installed, and the first hinge section and the second hinge section may form the rotational center.

The movable member may include a stopper section provided at one side of the first hinge section and configured to limit a rotational angle of the rotary member.

The hooking member may be integrally formed with one side of the rotary member.

The rotary member may include a protrusion protruding from an upper end thereof in the first direction and supported by the print media on the first tray.

The apparatus may include a conveyance apparatus configured to convey the at least one conveyance module, wherein the conveyance apparatus comprises a driving motor, a driving pulley rotated by the driving motor, a driven pulley configured to receive a rotational force from the driving pulley to be rotated, and at least one conveyance belt hooked and rotated by the driving pulley and the driven pulley, and the at least one conveyance module is installed at the at least one conveyance belt.

The at least one conveyance module may include a pair of conveyance modules spaced apart from each other in a longitudinal direction of the at least one conveyance belt.

The at least one conveyance belt may include a pair of conveyance belts disposed in parallel and spaced apart from each other in a second direction perpendicular to the first direction, and the at least one conveyance module may be installed at each of the pair of conveyance belts.

The apparatus may include a pair of alignment plates movably installed in a second direction perpendicular to the first direction of the first tray.

The apparatus may further include a stapler disposed on one side of the first tray and configured to staple the print media on the first tray.

A print medium finishing apparatus according to an aspect of an embodiment includes a main body, a first tray and a second tray sequentially provided at the main body in a first direction, which is a moving direction of print media, and a conveyance apparatus configured to convey the print media on the first tray to the second tray, wherein the conveyance apparatus comprises a driving motor, a driving pulley rotated by the driving motor, a driven pulley spaced apart from the driving pulley, a conveyance belt hooked by the driving pulley and the driven pulley, and a conveyance module disposed by the conveyance belt, the main body comprises a support section disposed at one side of the first tray and configured to support one ends of the print media stacked on the first tray, and a through-hole formed in the support section and configured to move the conveyance module in the first direction to pass through the support section, the conveyance module comprises a movable member movably installed in the first direction, and a rotary member rotatably installed at the movable member and configured to support the print media on the first tray, the rotary member comprises a hooking member having a lower end extending to a position under a rotational center of the rotary member, and the support section comprises a hooking threshold member protruding into the through-hole and to which the lower end of the hooking member is hooked.

Since the print media may be conveyed to a second tray in a state in which the print media on a first tray are supported by a rotated rotary member, disorder of the alignment of the print media during the conveyance process is reduced.

BRIEF DESCRIPTION OF THE DRAWINGS

These and/or other aspects of the invention will become apparent and more readily appreciated from the following description of the embodiments, taken in conjunction with the accompanying drawings of which.

DETAILED DESCRIPTION

Figure 1:
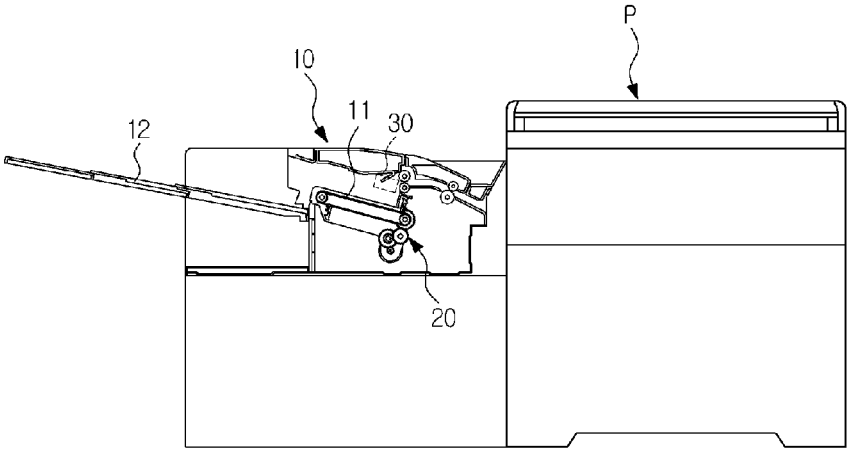
FIG. 1 illustrates a print medium finishing apparatus according to an embodiment installed at an image forming apparatus.

Reference will now be made in detail to the embodiments, examples of which are illustrated in the accompanying drawings, wherein like reference numerals refer to like elements throughout.

A print medium finishing apparatus according to an embodiment o is described with reference to the accompanying drawings.

As illustrated in FIG. 1, the print medium finishing apparatus according to an embodiment includes a body, e.g., a main body 10 connected to an image forming apparatus P, a first tray 11 disposed on the main body 10 and on which print media transmitted from the image forming apparatus P are stacked, a second tray 12 on which the finished print media are stacked on the first tray 11, and a conveyance apparatus 20 configured to convey the finished print media from the first tray 11 to the second tray 12.

Figure 2:
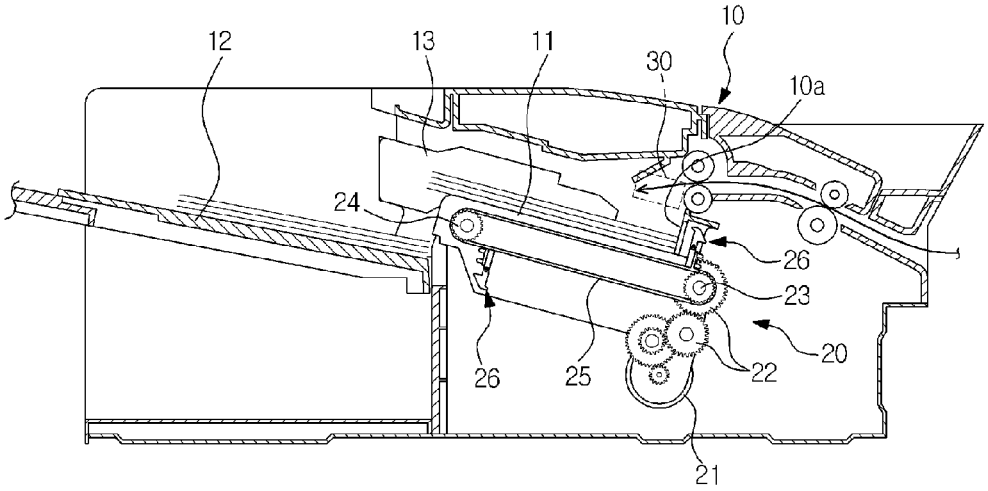
FIG. 2 illustrates a print medium finishing apparatus according to an embodiment.
Figure 3:
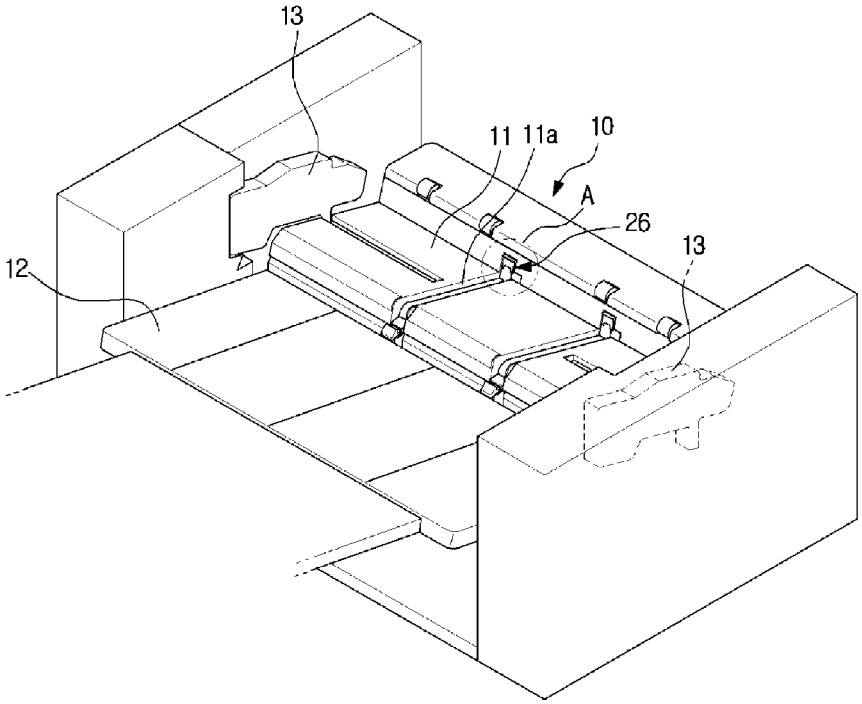
FIG. 3 illustrates a print medium finishing apparatus according to an embodiment.

As illustrated in FIGS. 2 and 3, alignment plates 13, e.g., a pair of alignment plates configured to align the print media stacked on the first tray 11 may be disposed at both sides of the first tray 11. A stapler 30 configured to staple the print media placed on the first tray 11 may be disposed, for example, on one side of the first tray 11.

The two alignment plates 13 may be installed on the first tray 11 to be movable in a first direction, which may be a discharge direction of the print media, and a second direction, which may be a vertical direction, to press and align both sides of the print media stacked on the first tray 11. The alignment plate 13 may function to move the print media such that the part, e.g., the sides of the print media to be stapled are disposed under the stapler 30.

The second tray 12 may be disposed in the first direction to be parallel to the first tray 11, and disposed under the first tray 11 so that the print media conveyed in the first direction are stacked on the first tray 11.

The conveyance apparatus 20 includes a driving motor 21 configured to generate a rotational force, a driving pulley 23 configured to receive the rotational force from the driving motor 21 through gears 22 to be rotated, a driven pulley 24 spaced apart from the driving pulley 23, a conveyance belt 25 hung on the driving pulley 23 and the driven pulley 24 to move around the driving pulley 23 and the driven pulley 24 according to rotation of the driving pulley 23, and a conveyance module 26 disposed at the conveyance belt 25 to be moved with the conveyance belt 25 and configured to convey the print media on the first tray 11 to the second tray 12.

According to an embodiment, the conveyance belt 25 includes a plurality, e.g., two conveyance belts 25 disposed in parallel and spaced apart from each other in a second direction such that the print media can be stably conveyed. The conveyance modules 26 may be installed at the two conveyance belts 25 at corresponding positions so that both sides of the print media on the first tray 11 simultaneously receive forces by the conveyance modules 26 to be conveyed.

According to an embodiment, the conveyance modules 26 may be disposed at the conveyance belts 25 to be spaced apart from each other in the longitudinal direction of the conveyance belts 25. The conveyance modules 26 disposed at the conveyance belts 25 alternately convey the print media on the first tray 11 to the second tray 12.

The main body 10 includes a support section 10*a* disposed at one side of the first tray 11 and configured to support, e.g., one end(s) of the print media stacked on the first tray 11. A through-hole 10*b* (see, for example, FIG. 4) may be formed in the support section 10*a* and through which the conveyance module 26 passes through the support section 10*a* in a first direction to enter the first tray 11, for example, from an upper side thereof. A slot 11*a* may be formed in the first tray 11 and through which the conveyance module 26 is able to move in the first direction while protruding over the first tray 11.

According to an embodiment, since the conveyance apparatus 20 includes the pair of conveyance belts 25 and the conveyance modules 26 are installed at the conveyance belts 25, through-holes 10*b*, e.g., two through holes and the slots 11*a*, e.g., two slots may be formed to correspond to the two conveyance belts 25.

Figure 4:
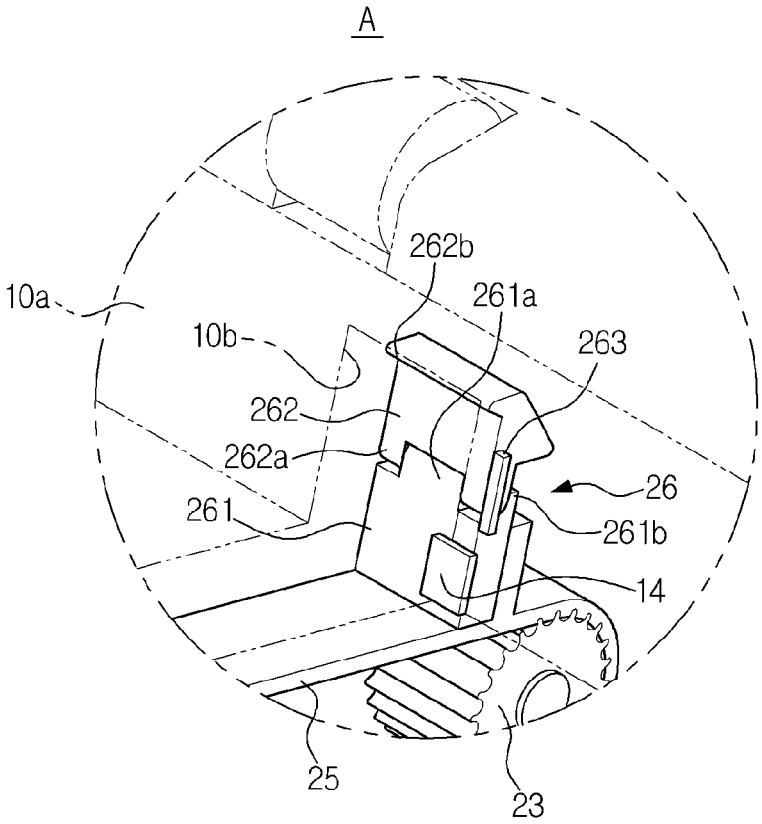
FIG. 4 illustrates a conveyance module applied to a print medium finishing apparatus according to an embodiment.

As illustrated in FIG. 4, the conveyance module 26 includes a movable member 261 movably installed at the first tray 11 through the conveyance belt 25 in the first direction. A rotary member 262 may be rotatably installed at the movable member 261, and pass through the through-hole 10*b* according to movement of the conveyance belt 25 to move the first tray 11 in the first direction.

The movable member 261 may be configured to move with the conveyance belt 25 as one end thereof may be fixed to the conveyance belt 25 to move the conveyance belt 25. A first hinge section 261*a*, to which the rotary member 262 may be rotatably installed, may be provided at the other end of the movable member 261. A stopper section 261*b* configured to limit a rotational angle of the rotary member 262 may be provided, for example, at one side of the first hinge section 261*a*.

A second hinge section 262*a* rotatably installed at the first hinge section 261*a* may be provided at one end of the rotary member 262. A protrusion 262*b* protruding in the first direction and configured to support the print media stacked on the first tray 11 may be formed at the other end of the rotary member 262. Accordingly, the rotary member 262 can rotate about the first hinge section 261*a* and the first hinge section 261*a*, which are rotatably installed, serving as a rotational center. The protrusion 262*b* of the rotary member 262 supports a side of the print media placed on the first tray 11 in a state in which the rotary member 262 is rotated.

The rotary member 262 may be rotated to support the print media on the first tray 11 while passing the through-hole 10*b*. The conveyance module 26 may be moved to move the print media in the first direction in a state in which the protrusion 262*b* of the rotary member 262 presses the print media.

A hooking member 263, for example, having a lower end extending to be disposed under a rotational center of the above-mentioned rotary member 262, may be provided at the rotary member 262 such that the rotary member 262 is rotated while passing the through-hole 10*b*. The main body 10 includes a hooking threshold member 14 protruding into the through-hole 10*b* to be hooked by the lower end of the hooking member 263. According to an embodiment, the hooking member 263 may be separately manufactured from the rotary member 262 and, for example, fixed to a side of the rotary member 262. The hooking threshold member 14 may be separately manufactured from the support section 10*a* and, for example, fixedly installed at the support section 10*a*.

An exemplary operation of a print medium finishing apparatus according to an embodiment is described.

An exemplary print medium finishing apparatus receives the print media, on which image forming, for example, is finished, from the image forming apparatus P connected to the main body 10, and stacks the print media on the first tray 11.

When a set number of print media are stacked on the first tray 11, the two alignment plates 13 move to advance and retract in the second direction at both sides of the print media to align the print media stacked on the first tray 11.

When the alignment of the print media is terminated, the two alignment plates 13 move the print media to one side in the second direction such that the one sides of the print media to be stapled are disposed under the stapler 30. The stapler 30 is operated, for example, upward and downward, to staple, e.g., one sides of the print media after completion of movement of the print media.

Figure 5:
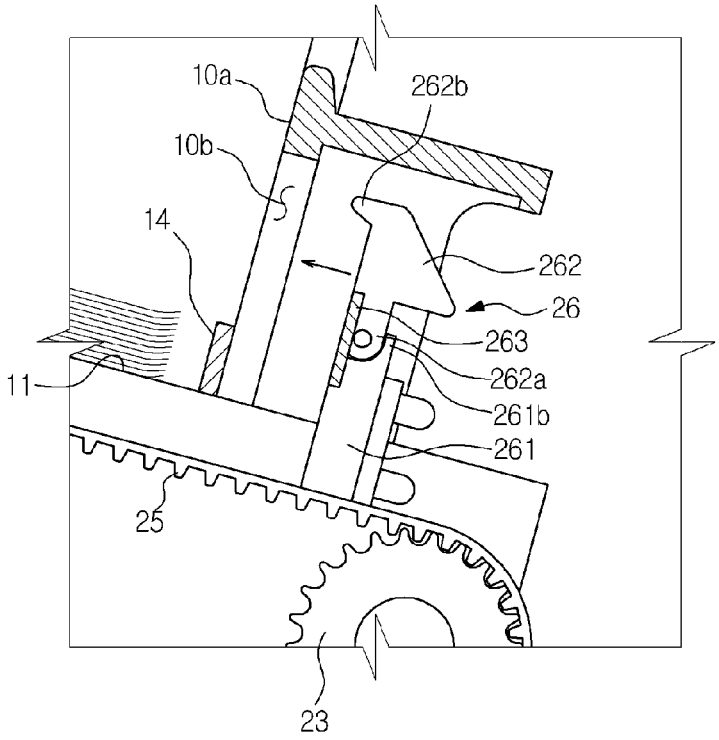
FIGS. 5 and 6 are exemplary side cross-sectional views illustrating exemplary operational states of a conveyance module applied to a print medium finishing apparatus according to an embodiment.

After the stapling is terminated, a rotational force may be generated from the driving motor 21 to rotate the conveyance belt 25 around the driving pulley 23 and the driven pulley 24. As illustrated in FIG. 5, the conveyance module 26 may be moved in the first direction according to rotation of the conveyance belt 25 to pass through the through-hole 10*b* to protrude over the first tray 11.

Figure 6:
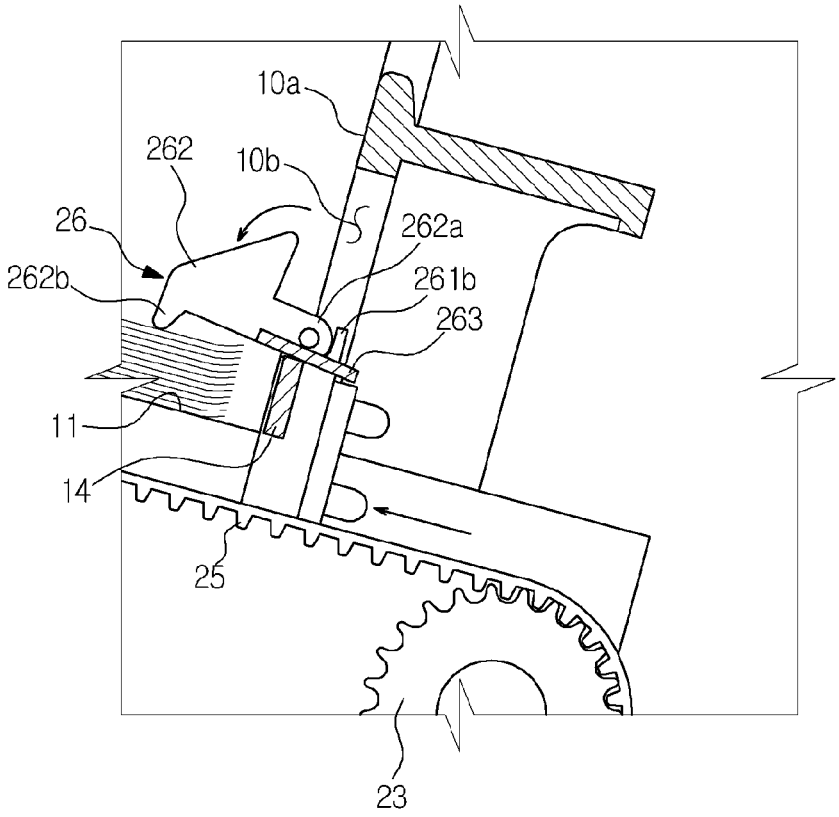

During a process in which the conveyance module 26 passes through the through-hole 10*b*, an end, e.g., a lower end of the hooking member 263, provided at one side of the rotary member 262, may be hooked by the hooking threshold member 14 protruding into the through-hole 10*b*. Since the lower end of the hooking member 263 may be disposed under the rotational center of the rotary member 262, as illustrated in FIG. 6, the rotary member 262 may be hooked and rotated by the hooking member 263. As the rotary member 262 is rotated, the protrusion 262*b* of the rotary member 262 supports a side, e.g., the one sides of the print media stacked on the first tray 11.

The conveyance module 26 moves, e.g., continuously moves in the first direction, and the print media stacked on the first tray 11 are conveyed by the conveyance module 26 in the first direction to move to the second tray 12. Since the one sides of the print media are maintained while being supported by the protrusion 262*b* of the rotary member 262 even during a process of conveying the print media, disorder of alignment of the print media during the conveyance process is reduced.

Figure 7:
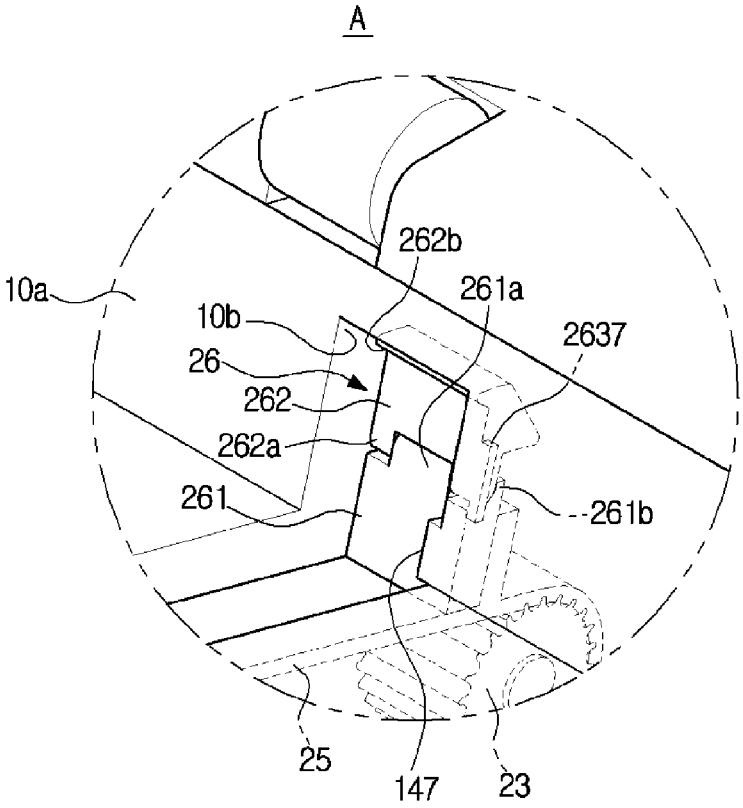
FIG. 7 is a perspective view of an exemplary conveyance module applied to a print medium finishing apparatus according to an embodiment.

According to an embodiment, while the hooking member 263 and the hooking threshold member 14 may be separately manufactured from the rotary member 262 and the support section 10*a* and then installed at the rotary member 262 and the support section 10*a*, respectively, an embodiment is not limited thereto. As illustrated in FIG. 7, a hooking member 2637 may be integrally formed, for example, with one side of the rotary member 262 during the process of manufacturing the rotary member 262. A hooking threshold member 147 may be integrally formed with the support section 10*a* during the process of forming the support section 10*a*.

Although a few embodiments have been illustrated and described, it would be appreciated by those skilled in the art that changes may be made in these embodiments without departing from the principles and spirit of the invention, the scope of which is defined in the claims and their equivalents.

What is claimed is:

1. A print medium finishing apparatus comprising:

a main body;

a first tray and a second tray sequentially provided in the main body in a first direction, which is a moving direction of print media; and at least one conveyance module disposed in the first tray and configured to convey the print media on the first tray to the second tray, wherein the main body comprises a support section provided on one side of the first tray and configured to support one ends of the print media stacked on the first tray, and a through-hole formed in the support section and through which the conveyance module moves in the first direction to pass through the support section, the conveyance module comprises a movable member movably installed in the first direction, and a rotary member rotatably installed on the movable member and configured to support the print media on the first tray, and wherein the rotary member comprises a hooking member having a lower end disposed under a rotational center of the rotary member, wherein the support section has a hooking threshold member protruding into the through-hole, and wherein the lower end of the hooking member hooked by the hooking threshold member while the hooking member passing through the through-hole.

2. The print medium finishing apparatus according to claim 1, wherein the movable member comprises a first hinge section to which the rotary member is rotatably installed, the rotary member comprises a second hinge section to which the first hinge section is rotatably installed, and the first hinge section and the second hinge section form the rotational center.

3. The print medium finishing apparatus according to claim 2, wherein the movable member comprises a stopper section provided on one side of the first hinge section and configured to limit a rotational angle of the rotary member.

4. The print medium finishing apparatus according to claim 1, wherein the hooking member is integrally formed with one side of the rotary member.

5. The print medium finishing apparatus according to claim 1, wherein the rotary member comprises a protrusion protruding from an upper end thereof in the first direction and supported by the print media on the first tray.

6. The print medium finishing apparatus according to claim 1, further comprising a conveyance apparatus configured to convey the at least one conveyance module, wherein the conveyance apparatus comprises a driving motor, a driving pulley rotated by the driving motor, a driven pulley configured to receive a rotational force from the driving pulley to be rotated, and at least one conveyance belt hooked and rotated by the driving pulley and the driven pulley, and the at least one conveyance module is installed on the at least one conveyance belt.

7. The print medium finishing apparatus according to claim 6, wherein the at least one conveyance module comprises a pair of conveyance modules spaced apart from each other in a longitudinal direction of the at least one conveyance belt.

8. The print medium finishing apparatus according to claim 6, wherein the at least one conveyance belt comprises a pair of conveyance belts disposed in parallel and spaced apart from each other in a second direction perpendicular to the first direction, and the at least one conveyance module is installed on each of the pair of conveyance belts.

9. The print medium finishing apparatus according to claim 1, further comprising a pair of alignment plates movably installed in a second direction perpendicular to the first direction of the first tray.

10. The print medium finishing apparatus according to claim 1, further comprising a stapler disposed on one side of the first tray and configured to staple the print media on the first tray.

* * * * *